US007088036B2

(12) United States Patent
Kanda et al.

(10) Patent No.: US 7,088,036 B2
(45) Date of Patent: Aug. 8, 2006

(54) METHOD FOR MANUFACTURING IMAGE DISPLAY DEVICE, IMAGE DISPLAY DEVICE, AND TV APPARATUS

(75) Inventors: Makoto Kanda, Tokyo (JP); Masahiro Tagawa, Kanagawa (JP); Tomokazu Andoh, Kanagawa (JP); Takahiro Oguchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 100 days.

(21) Appl. No.: 10/914,281

(22) Filed: Aug. 10, 2004

(65) Prior Publication Data

US 2005/0009434 A1 Jan. 13, 2005

(30) Foreign Application Priority Data

Aug. 15, 2003 (JP) ..... 2003-293956

(51) Int. Cl.
*H01J 1/66* (2006.01)
*H01J 1/88* (2006.01)

(52) U.S. Cl. ..... 313/495; 313/292; 313/238

(58) Field of Classification Search ..... 313/495–497, 313/292, 238
See application file for complete search history.

(56) References Cited

U.S. PATENT DOCUMENTS 5,821,689 A 10/1998 Andoh et al. ..... 313/495
6,104,136 A * 8/2000 Abe et al. ..... 313/495
6,172,454 B1 * 1/2001 Hofmann ..... 313/495
6,420,824 B1 * 7/2002 Abe et al. ..... 313/495
6,494,757 B1 12/2002 Yamazaki et al. ..... 445/24
6,541,900 B1 4/2003 Ando ..... 313/292
2002/0195966 A1 12/2002 Aoki et al. ..... 315/169.3
2003/0003838 A1 1/2003 Yamazaki et al. ..... 445/24
2003/0080673 A1 5/2003 Ando ..... 313/495

FOREIGN PATENT DOCUMENTS

JP 7-302560 11/1995
JP 2000-260353 9/2000
JP 2000-311608 11/2000
JP 2003-173159 6/2003

OTHER PUBLICATIONS

U.S. Appl. No. 10/931,049, filed Sep. 1, 2004, Tomokazu Andoh.

* cited by examiner

*Primary Examiner*—Joseph Williams
*Assistant Examiner*—Peter Macchiarolo
(74) *Attorney, Agent, or Firm*—Fitzpatrick, Cella, Harper & Scinto

(57) ABSTRACT

An image display device of a high quality, in which the variation of heights between adjoining spacers is reduced by measuring the heights of spacers to arrange the spacers from the end in the sequential order of heights so that the mechanical precision of the spacers need not be strictly managed.

2 Claims, 22 Drawing Sheets

METHOD FOR MANUFACTURING IMAGE DISPLAY DEVICE, IMAGE DISPLAY DEVICE, AND TV APPARATUS

BACKGROUND OF THE INVENTION

1. Field of the Invention

The present invention relates to a method for manufacturing an image display device having a pair of substrates arranged opposite each other, the image display device, and a TV apparatus.

2. Description of the Related Art

An image display device, which is provided with a plurality of plate-shaped spacers or columnar spacers arranged between a pair of substrates arranged opposite each other, is known in the related art (as referred to JP-A-07-302560 or JP-A-2000-260353, for example). FIG. 1 is a partially broken perspective view of an image display device which is provided with plate-shaped spacers.

In FIG. 1: reference numeral 1 designates a rear plate mounting a plurality of electron emitting devices (although not shown); numeral 2 a face plate mounting fluorescent elements (although not shown) and arranged opposite the rear plate 1; numeral 3 an outer frame connecting the peripheries of the rear plate 1 and the face plate 2; and numeral 4 plate-shaped spacers arranged between the rear plate 1 and the face plate 2. The rear plate 1, the face plate 2 and the outer frame 3 form a vacuum container together.

By using the drive method and the drive circuit disclosed in JP-A-2003-173159, for example, electron beams are emitted to irradiate fluorescent elements by matrix-arranged electron emitting devices so that images are displayed.

SUMMARY OF THE INVENTION

With a variation in the heights of the spacers disposed in the vacuum container, the spacers and the substrates may vary in their contact state or may increase in their non-contact portions. Thus, the vacuum container has its mechanical strength lowered. With the variation in the spacer heights, moreover, many point contacts occur between the spacers and the substrates. These point contacts are desired to be as few as possible, because they cause discharges.

The method of the related art for manufacturing the image display device has endeavored to homogenize the heights of the individual portions of each spacer and to suppress the variation in the heights of the spacers. An image display device having less deformation as the vacuum container has been realized by those endeavors. However, it is followed by technical difficulties to mass-produce the spacers having such mechanical precision stably. Moreover, a number of spacers, if any, dissatisfying predetermined standards will cause a rise in the resultant cost for the image display device.

An object of the invention is to stabilize a mechanical strength without demanding the spacers for a high mechanical precision.

Another object of the invention is to suppress discharges, as might otherwise occur between the spacers and the substrates, without demanding the spacers for the high mechanical precision.

Still another object of the invention is to lower the cost while keeping a high quality.

In order to achieve the objects thus specified, the following constructions are adopted according to the invention.

According to an aspect of the invention, there is provided a method for manufacturing an image display device including: a rear plate having a plurality of electron emitting devices arranged thereon; a face plate arranged opposite the rear plate and having image forming members arranged for forming images when irradiated with electron beams emitted from the electron emitting devices; and a plurality of spacers arranged between the face plate and the rear plate, comprising:

the measuring step of measuring the heights of the plural spacers individually; and the arranging step of arranging the spacers between the face plate and the rear plate on the basis of the measured values obtained at the measuring step.

Here: the spacers are plate-shaped spacers;

the measuring step measures the heights of the plural plate-shaped spacers individually at a plurality of portions; and the arranging step includes:

the step of calculating average values of the heights of the individual spacers; and the step of arranging the spacers between the face plate and the rear plate in the sequential order from an end portion in accordance with the magnitudes of the average values of the heights.

On the other hand: the spacers are plate-shaped spacers;

the measuring step includes;

the step of measuring the heights of the plural plate-shaped spacers individually at a plurality of portions; and the step of calculating average values of the heights with respect to the individual spacers; and the arranging step includes;

the step of setting a reference curve or straight line with respect to the average values arranged in the sequential order of the magnitudes by setting an initial state in which the spacers are arranged in the sequential order of the larger average values;

the step of setting a first curve or straight line and a second curve or straight line with the reference curve or straight line as a center and above and below the reference curve or straight line across a predetermined width; and the step of interchanging the array order of the spacers so that the height values of the individual spacers measured at the plural portions may be positioned between the first curve or straight line and the second curve or straight line.

On the other hand: the spacers are plate-shaped spacers;

the measuring step includes:

the step of measuring the heights of the plural plate-shaped spacers individually at a plurality of portions; and the step of calculating average values of the heights with respect to the individual spacers; and the arranging step includes: plotting an average height value of the spacers in a manner to correspond to the positions of the individual spacers across a predetermined spacing by setting an initial state in which the spacers are arranged at the predetermined spacing in the sequential order of the larger average values; and interchanging the array order of the spacers, while imagining a straight line jointing the average height values of the two of the plural spacers at the two ends, so that the differences between the individual average heights at the positions of the individual spacers and the values of the straight line at the positions may be a predetermined threshold value or less.

Moreover, the predetermined threshold value is determined depending on the characteristics of at least either of the rear plate and the face plate.

On the other hand: the spacers are columnar spacers; and the arranging step arranges the columnar spacers so that the spacing between the face plate and the rear plate may vary monotonously in a predetermined direction.

Moreover, the arranging step arranges the spacers between the face plate and the rear plate sequentially in a diagonal direction in the order from the end portion according to the magnitudes of the measured values.

According to another aspect of the invention, there is provided an image display device comprising:

a rear plate having a plurality of electron emitting devices arranged thereon;

a faceplate arranged opposite the rear plate and having image forming members arranged for forming images when irradiated with electron beams emitted from the electron emitting devices; and a plurality of spacers arranged between the face plate and the rear plate and from the end in the sequential order of heights.

According to still another aspect of the invention, there is provided a TV apparatus comprising:

an image display device including: a rear plate having a plurality of electron emitting devices arranged thereon; a face plate arranged opposite the rear plate and having image forming members arranged for forming images when irradiated with electron beams emitted from the electron emitting devices; and a plurality of spacers arranged between the face plate and the rear plate and from the end in the sequential order of heights; and a receiving device for receiving TV signals.

DETAILED DESCRIPTION OF THE PREFERRED EMBODIMENTS

Embodiments of the invention will be described in detail in the following.

[First Embodiment]

Figure 1:
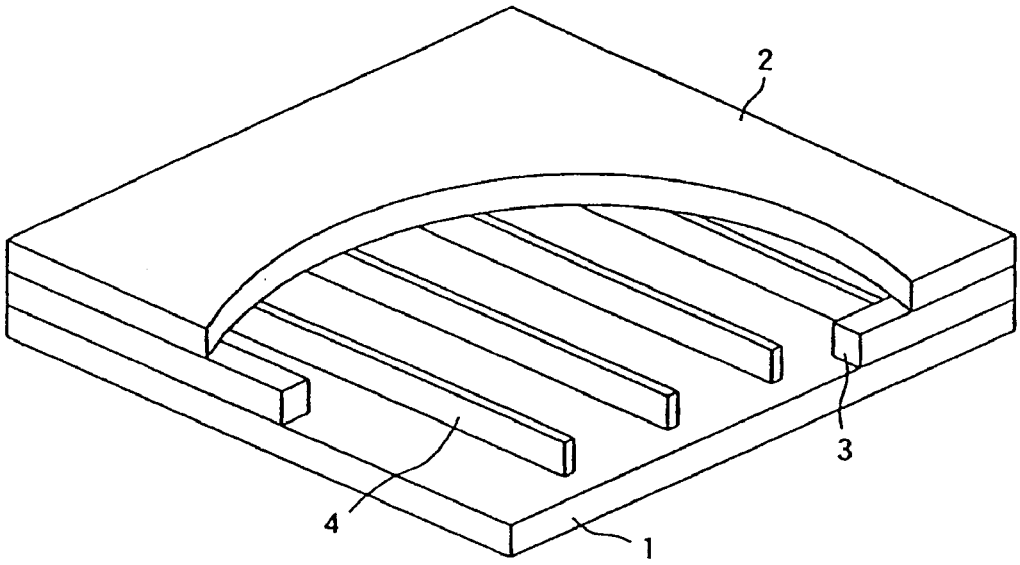
FIG. 1 (PRIOR ART)
FIG. 1 is a partially broken perspective view of an image display device provided with plate-shaped spacers.
Figure 2:
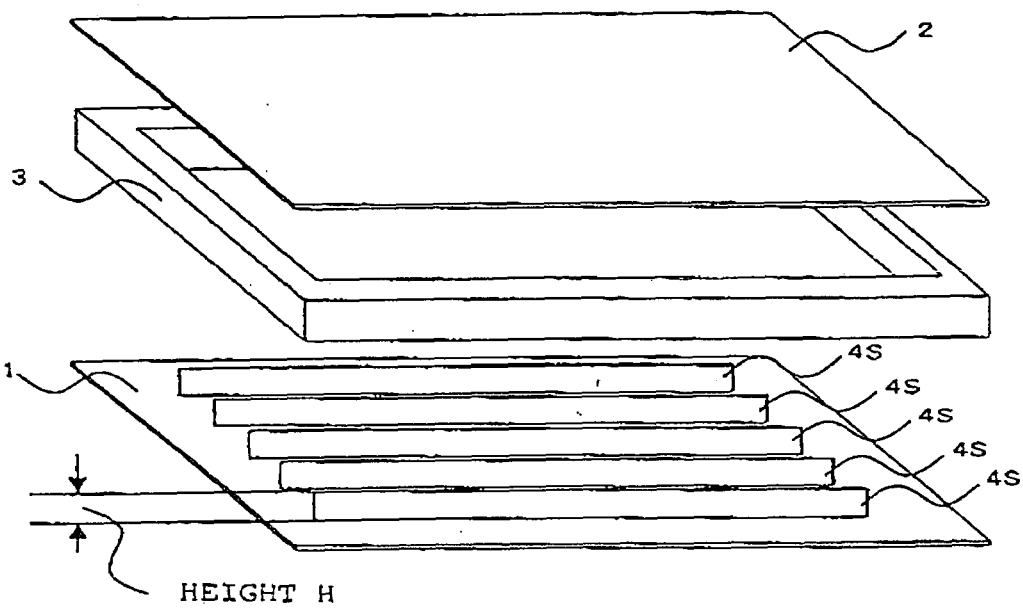
FIG. 2 is an explanatory view for explaining an arrangement of plate-shaped spacers in an embodiment of the FIG. 3 is a transverse section of the image display device, in which the arrangement of the plate-shaped spacers is adjusted and controlled into a wedge shape.

In this embodiment, plate-shaped spacers are used as support members. FIG. 2 is a view for explaining an arrangement of the plate-shaped spacers. Reference numeral 1 designates a rear plate; numeral 2 a front plate arranged opposite the rear plate 1; and numeral 3 an outer frame for forming a vacuum container. FIG. 2 shows the behavior, in which five plate-shaped spacers 4S are arranged, for example, between the rear plate 1 and the face plate 2.

Here, the plate-shaped spacers 4S can be prepared by a heating drawing. According to this heating drawing, it is possible (as referred to JP-A-2000-311608, for example) to easily prepare the plate-shaped spacers 4S which can suppress scattering of secondary electrons.

Figure 4:
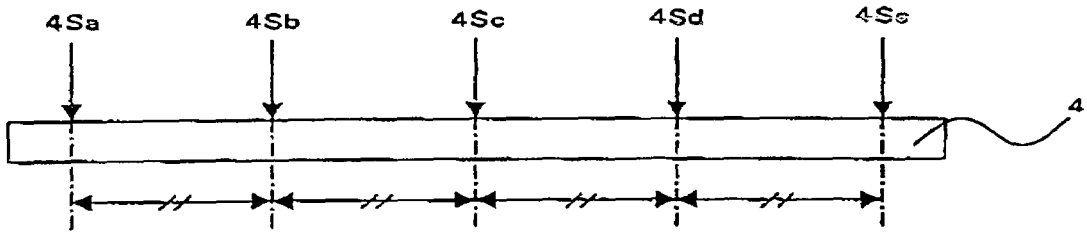
FIG. 4 is a diagram showing an example of measurement positions of the case, in which five measurement points of the plate-shaped spacers are set.

This embodiment is provided with measurement means for measuring the heights H (as referred to FIG. 2) of the individual plate-shaped spacers. FIG. 4 schematically shows the measurement points in the height measurements of the plate-shaped spacers. In this embodiment, the heights H are measured at the center position 4Sc in the longitudinal direction of the plate-shaped spacers. As a result, the individual plate-shaped spacers have the measurement information on those heights H.

Figure 5:
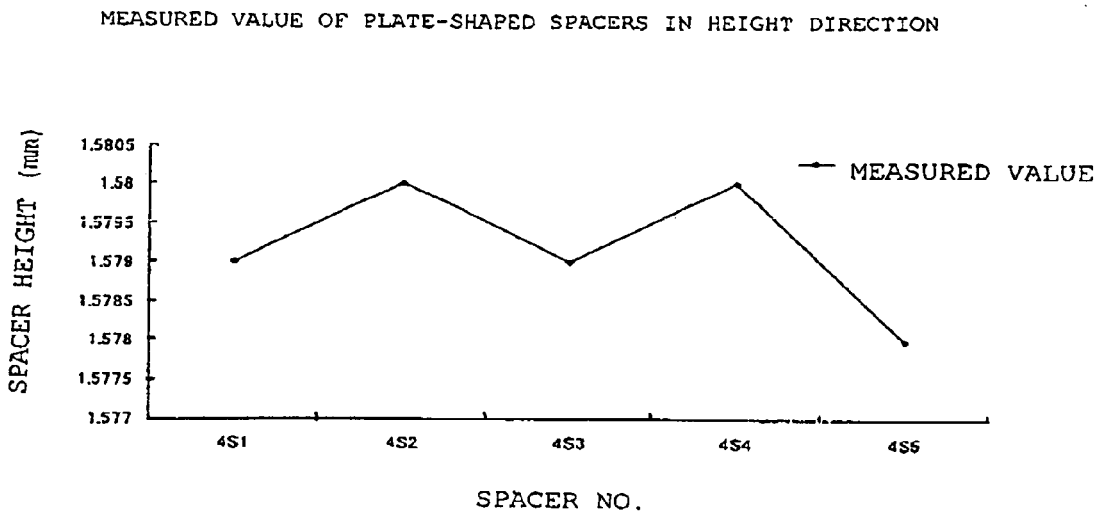
FIG. 5 is a diagram illustrating an example of the measured height values of the plate-shaped spacers.

FIG. 5 is a graph plotting the measured data of the heights owned by the individual five plate-shaped spacers, such that the plate-shaped spacers are suitably selected from the numerous plate-shaped spacers and are arranged at random (with spacer numbers of 4S1 to 4S5 in this arrangement). Here, the random arrangement of the plate-shaped spacers includes not only the case, in which the plate-shaped spacers are actually arranged, but also the case, in which the plate-shaped spacers are virtually arranged (so that they may be controlled by a computer).

In the case of the example illustrated in FIG. 5: the spacer 4S1 has a height=1.579 mm; the spacer 4S2 has a height=1.580 mm; the spacer 4S3 has a height=1.579 mm; the spacer 4S4 has a height=1.580 mm; and the spacer 4S5 has a height=1.578 mm.

Here in this embodiment, the measured values of the heights of the spacers obtained by the measurement means are used so they are arranged in the sequential order from the larger one.

Figure 6:
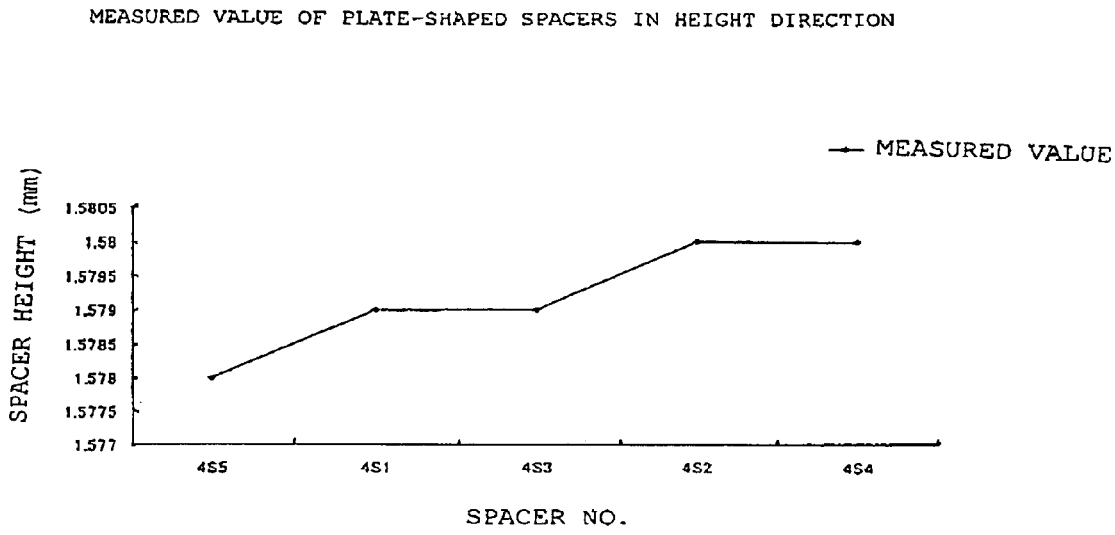
FIG. 6 is a diagram illustrating an example of the case, in which the measured height values of the plate-shaped spacers are arranged in the sequential order of larger numerical values.

FIG. 6 is a graph plotting the measured values of the individual plate-shaped spacers in the height direction after they are arranged in the sequential order from the larger values. Specifically, FIG. 6 plots the results of the arrangement, in which the plate-shaped spacers are arranged in the sequential order of the spacer 4S5←the spacer 4S1←the spacer 4S3←the spacer 4S2←the spacer 4S4.

Figure 3:
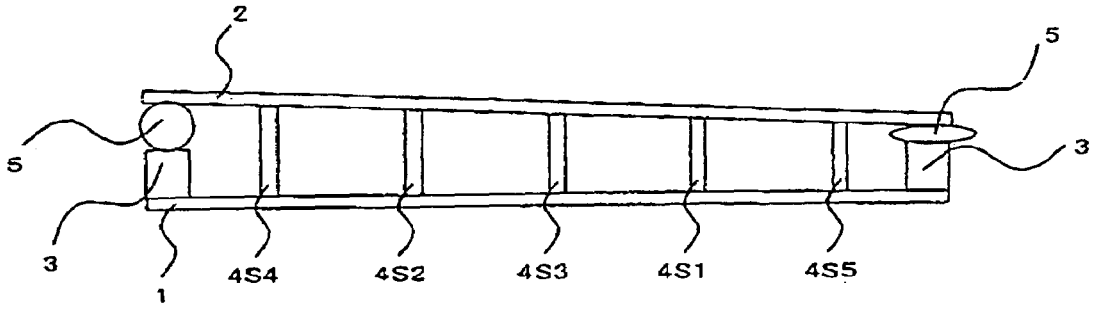

FIG. 3 is a transverse section of the image display device in case the individual plate-shaped spacers are arranged in the aforementioned order between the paired substrates arranged opposite each other. In FIG. 3: numeral 1 designates a rear plate; numeral 2 a face plate arranged opposite the rear plate 1; numeral 3 an outer frame for connecting the peripheries of the rear plate 1 and the face plate 2; numerals 4S1 to 4S5 plate-shaped spacers; and numeral 5 frits for adhering the outer frame 3 and the face plate 2. These frits 5 have thermally deforming properties. Here, the material for adhering the outer frame 3 and the face plate 2 should not be limited to the frits but can use a metal of a low melting point such as indium.

According to this embodiment, it was possible to manufacture an image display device which had a sectional shape controlled into a wedge shape reflecting the spacer height order. As a result, the maximum value of variation in the heights between the adjoining spacers could be reduced from Δ=0.002 mm to Δ=0.001 mm. Thus, it was possible to reduce the variation in the height between the adjoining spacers. Accordingly, the variation in the contact state between the spacer and the substrate (i.e., the rear plate 1 or the face plate 2) could be suppressed to suppress the occurrence of portions failing to contact with each other. Thus, the mechanical strength of the vacuum container could be stabilized without any strict management of the mechanical precision of the spacers. Moreover, the mechanical precision did not need to be strictly managed, but the number of spacers, which might otherwise have failed to satisfy the standards and be discarded, could be reduced to lower the cost. It was further possible to reduce the point contacts, as might otherwise have caused discharges, between the spacers and the substrates.

Here will be briefly described how to manufacture the image display device.

First of all, the rear plate 1 carrying electron emitting devices (although not shown) is set on a hot plate with its electron emitting devices being directed upward. Then, spacers 4 are arranged on the rear plate 1. At this time, the spacers 4 are arranged on the basis of the measured height values H, as described hereinbefore.

In case the spacers 4 are to be adhered to the side of the rear plate 1, frit glass is applied beforehand with a dispenser to at least portions of the positions, at which the spacers 4 are to be arranged. Then, the spacers 4 are arranged on the frit glass with a dedicated jig and are then heated so that they are adhered to the rear plate 1. Here, the positions, to which the frit glass is applied, can be only partially of the non-image areas of the faces of the substrate, with which the spacers 4 are to contact. Moreover, the frit glass may be applied to only one-side faces (as located on the side of the rear plate 1 or the face plate 2) or to both-side faces (as located on both the side of the rear plate 1 and the side of the face plate 2) of the spacers 4.

Next, the frame 3, in which the frit glass has been applied in advance to the portions to be contacted by the rear plate 1 and the portions to be contacted by the face plate 2, is set on the rear plate 1. Moreover, the face plate 2 carrying fluorescent elements (although not shown) is so positioned and fixed that the fluorescent elements may confront the electron emitting devices. Moreover, a hot plate is placed on the assembly and is heated to the adhering temperature of the frit glass while being loaded. After this, the assembly is cooled down to prepare a gas-tight container. After this, the internal air is discharged to a vacuum of about $10\times10^{-6}$ [Pa] through a discharge tube, for example, by an external vacuum pump. Thus, the vacuum container is manufactured.

In case surface conduction type electron emitting devices are used as the electron emitting devices, they are connected with an external drive circuit so that they are subjected to a forming, an activation and a power running such as a test run before the image display device is manufactured. When an image is to be displayed, the drive voltage is applied to the electron emitting devices, and a voltage as high as 3 KV to 15 KV is applied to an anode electrode arranged on fluorescent elements. As a result, the electron beam emitted from the electron emitting devices are accelerated to irradiate the fluorescent elements. Thus, the image display device functions with the emitting fluorescent elements.

[Second Embodiment]

This embodiment is identical to the first embodiment excepting that the method of measuring the heights of the spacers is different, and the description of its similar construction will be omitted.

In this embodiment, the measured values of the heights of the individual plate-shaped spacers were measured at multiple points in the plate-shaped spacers, and their average value was used. Specifically, the individual plate-shaped spacers were arranged on the basis of the average value.

FIG. 4 shows the measurement points of the plate-shaped spacers. In this embodiment, the heights of the plate shaped spacers were measured at the individual measurement points (4Sa, 4Sb, 4Sc, 4Sd and 4Se) which had been set at equal distances in the longitudinal direction of the plate-shaped spacers.

Figure 7:
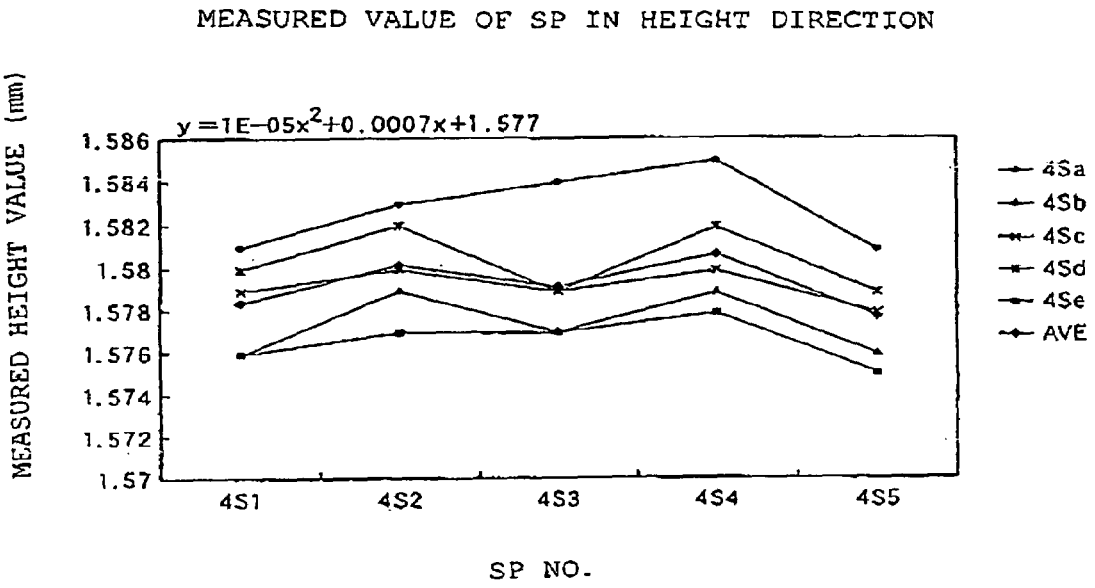
FIG. 7 is a diagram illustrating examples of the individual measured values and an average value of the case, in which five measurement points of the plate-shaped spacers are set, for example.

FIG. 7 is a graph showing the individual measured height values at the five measurement points set at the individual plate-shaped spacers and their average values AVE, in case the plate-shaped spacers are arranged at random like in FIG. 5. Like the first embodiment, the random arrangement of the plate-shaped spacers includes not only the case, in which the plate-shaped spacers are actually arranged, but also the case, in which the plate-shaped spacers are virtually arranged.

Figure 8:
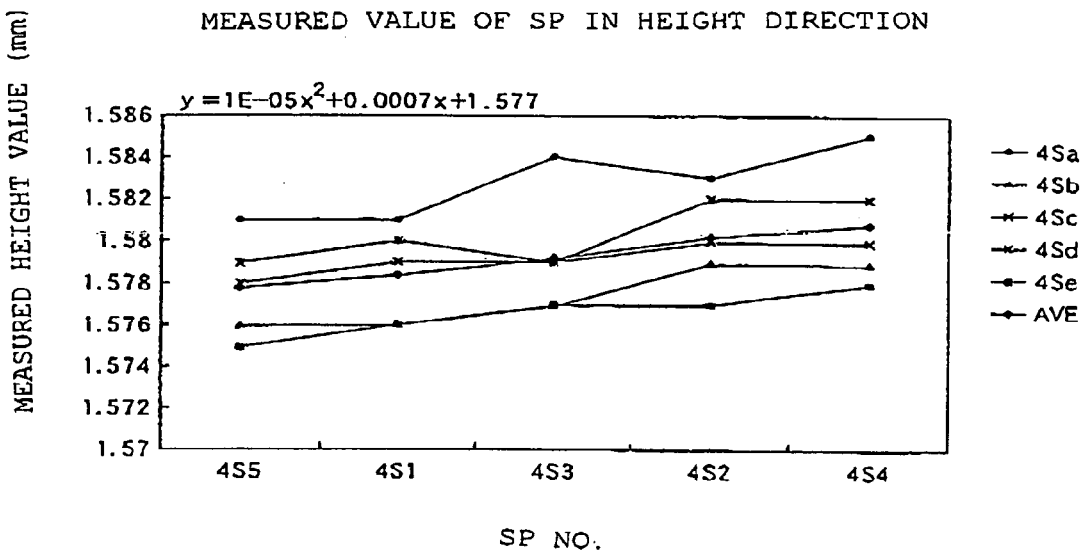
FIG. 8 is a diagram illustrating examples of the case, in which five measurement points of the plate-shaped spacers are arranged in the order of larger numerical values on the basis of their average value.

By arranging the plate-shaped spacers in the sequential order of the larger average values (AVE), the arrangement of the plate-shaped spacers was determined, as illustrated in FIG. 8. As a result, it was possible to manufacture the image display device, the sectional shape of which was controlled into the wedge shape reflecting the spacer height order. As a result, the maximum value of variation of the heights between the adjoining plate-shaped spacers could be reduced from Δ=0.004 mm to Δ=0.003 mm. As a result, it was possible to attain effects similar to those of the case of the first embodiment.

[Third Embodiment]

The fundamental construction of the image display device is identical to that of the first embodiment, and the description of a similar construction will be omitted.

Moreover, it is identical to the second embodiment that the heights of the individual plate-shaped spacers are measured at multiple points in the individual plate-shaped spacers so that their average value is determined. Therefore, the description of the identical point will be omitted. In this embodiment, the arrangement of the plate-shaped spacers is controlled by considering the in-plane distribution of the image display device due to the height irregularity with respect to the longitudinal direction of the plate-shaped spacers.

Figure 9:
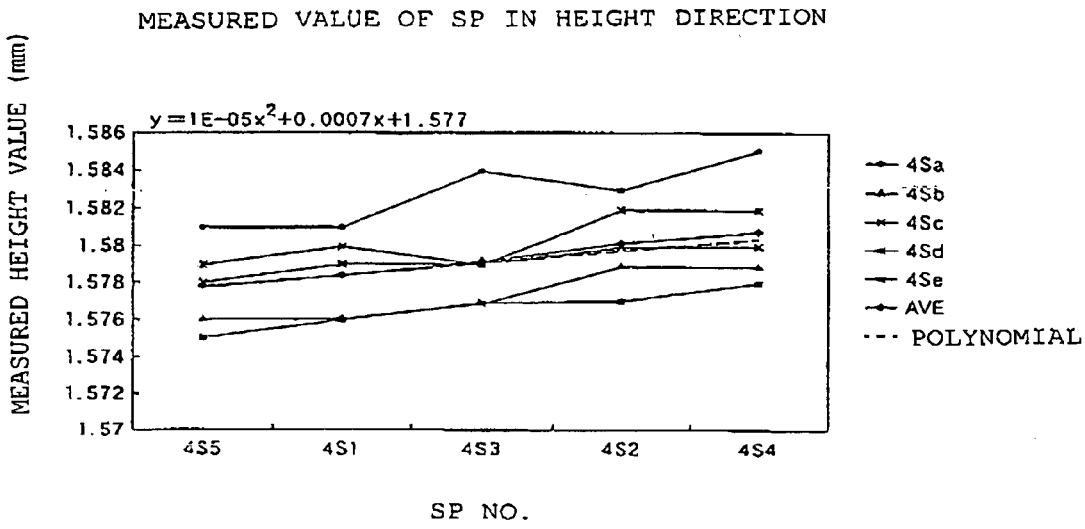
FIG. 9 is a diagram illustrating examples, in which a fundamental threshold value by a polynomial approximation method is set on the basis of the average value of FIG. 8.
Figure 12:
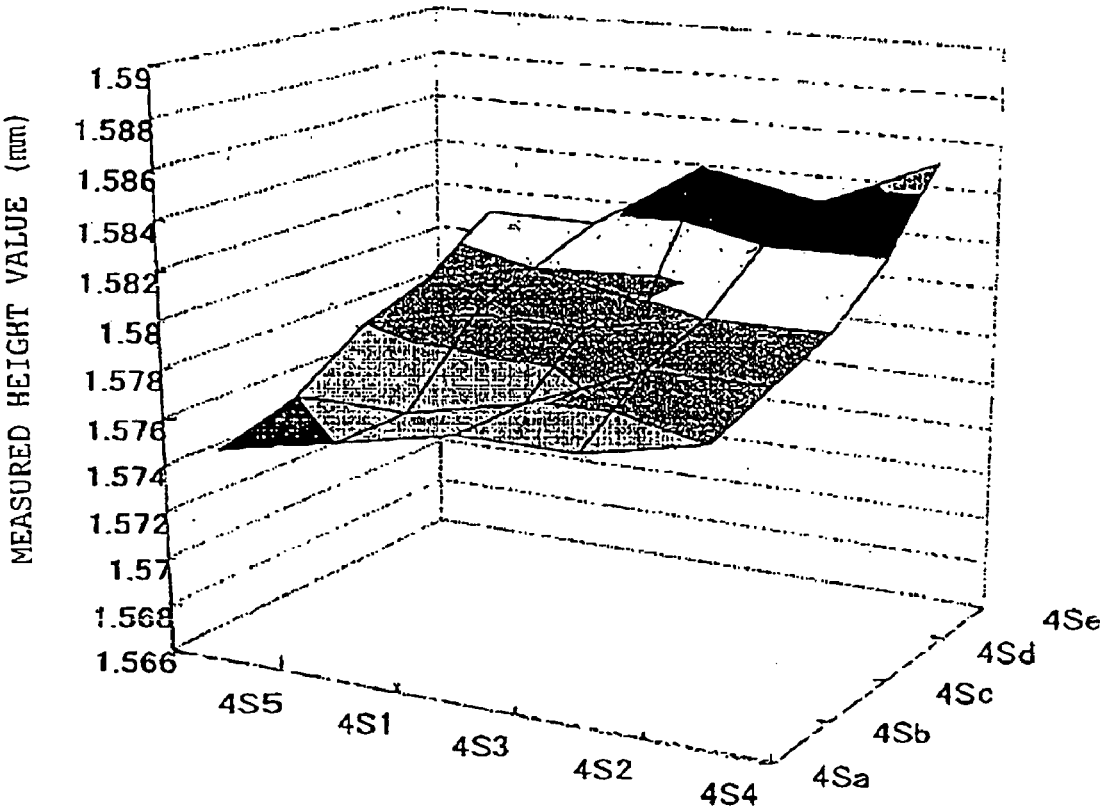
FIG. 12 is a diagram illustrating a planar distribution of the image display device in FIG. 9.

FIG. 9 shows a height distribution of the case, in which the plate-shaped spacers are arranged like the second embodiment in the sequential order from the larger average value. Moreover, the in-plane height distribution in this state is illustrated in FIG. 12. Here, the arrangement of the plate-shaped spacers in the sequential order of the larger average values includes not only the case, in which the plate-shaped spacers are actually arranged, but also the case, in which the plate-shaped spacers are virtually arranged (so that they may be controlled by a computer).

In this embodiment, the plate-shaped spacers are arranged at first on the basis of the average value, and a one-dimensional threshold value curve is then prepared on the basis of the average value. Next, an arbitrary offset value is given to that threshold value curve to determine an upper limit threshold value and a lower limit threshold value. In case the individual measurement points are not between the lower limit threshold value and the upper limit threshold value, the arrangement of the plate-shaped spacers is then adjusted. Thus, this embodiment is different from the first embodiment and the second embodiment in that the arrangement order is changed even after the plate-shaped spacers were once arranged (actually or virtually) in the sequential height order.

Figure 10:
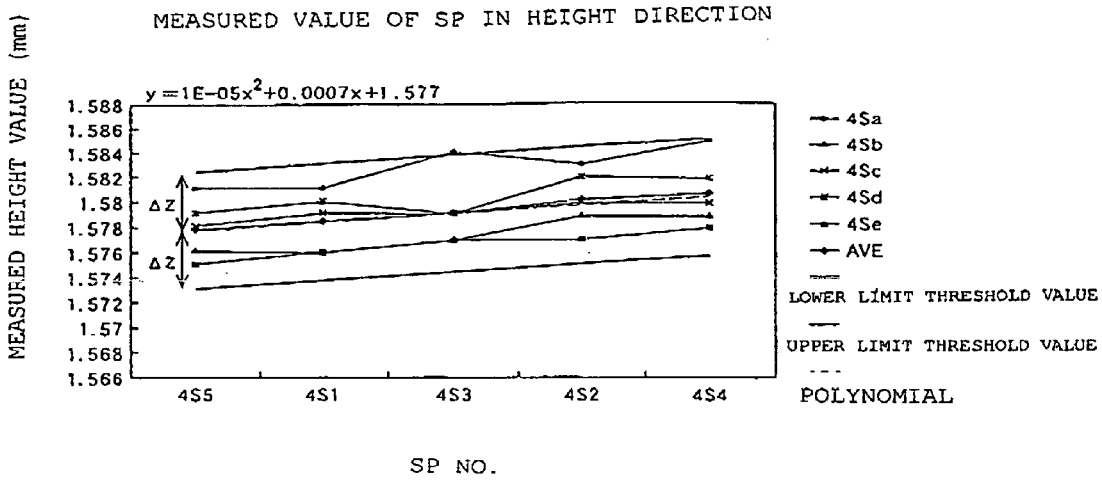
FIG. 10 is a diagram illustrating examples, in which a lower limit threshold value and an upper limit threshold value are set on the basis of the fundamental threshold value of FIG. 9.
Figure 11:
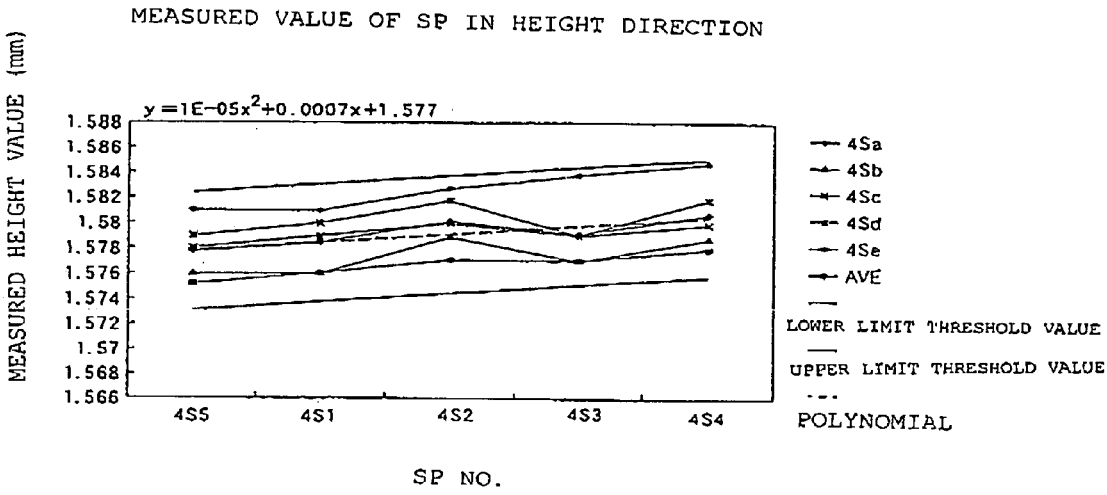
FIG. 11 is a diagram illustrating the measured values at the individual measurement points and an average value of the case, in which the arrangement of the spacers is changed on the basis of FIG. 10.

FIG. 10 and FIG. 11 plot examples, in which the one-dimensional threshold value curves are calculated after the plate-shaped spacers were arranged according to the average values. Here will be described the offset setting after the one-dimensional threshold value curves were calculated.

At first, the plate-shaped spacers are arranged like the second embodiment according to the average values. Then, an approximate curve is calculated according to a polynomial approximation method, for example, as illustrated in FIG. 9. As a result, the fundamental threshold value curve after arrangement based on the average values of the plate-shaped spacers is calculated. The curve formula in the example is expressed by:

$$y=1E-0.5X^2+0.0007X+1.577.$$

On the basis of the approximate curve thus calculated, curves (i.e., a curve for determining the lower limit threshold value and a curve for determining the upper limit threshold value), as illustrated in FIG. 10, are set by using an arbitrary offset value ΔZ.

In this embodiment, the value ΔZ is set at 0.0047 mm.

Next, the measurement points, at which the measured height values at the individual portions of the plate-shaped spacers are deviated from the range between the lower limit threshold value and the upper limit threshold value, are detected from the aforementioned curves illustrated in FIG. 10. For example, it is found in FIG. 10 that the measured value 4Sa of the spacer 4S3 exceeds the upper limit threshold value.

Here, the arrangement of the plate-shaped spacers is further changed in case a measured value is outside of the range between the lower limit threshold value and the upper limit threshold value. Specifically, in case a measured value exceeds the upper limit threshold value, for example, the position of the plate-shaped spacer is interchanged with the position of such one of the adjoining plate-shaped spacers as has a higher average value. In case a measured value falls short of the lower limit threshold value, on the contrary, the position of the plate-shaped spacer is interchanged with the position of such one of the adjoining plate-shaped spacers as has a lower average value. These permutations are repeated till no measured value deviates the range between the lower limit threshold value and the upper limit threshold value.

In the case of the aforementioned example, the arrangements of the spacer 4S3 and the spacer 4S2 are interchanged, for example. As a result, the order of the average values is reversed at the spacer 4S2 and the spacer 4S3, as illustrated in FIG. 11. For all spacers, however, it can hold that "the lower limit threshold value≦the measured height values of the individual measurement points≦the upper limit threshold value."

Figure 13:
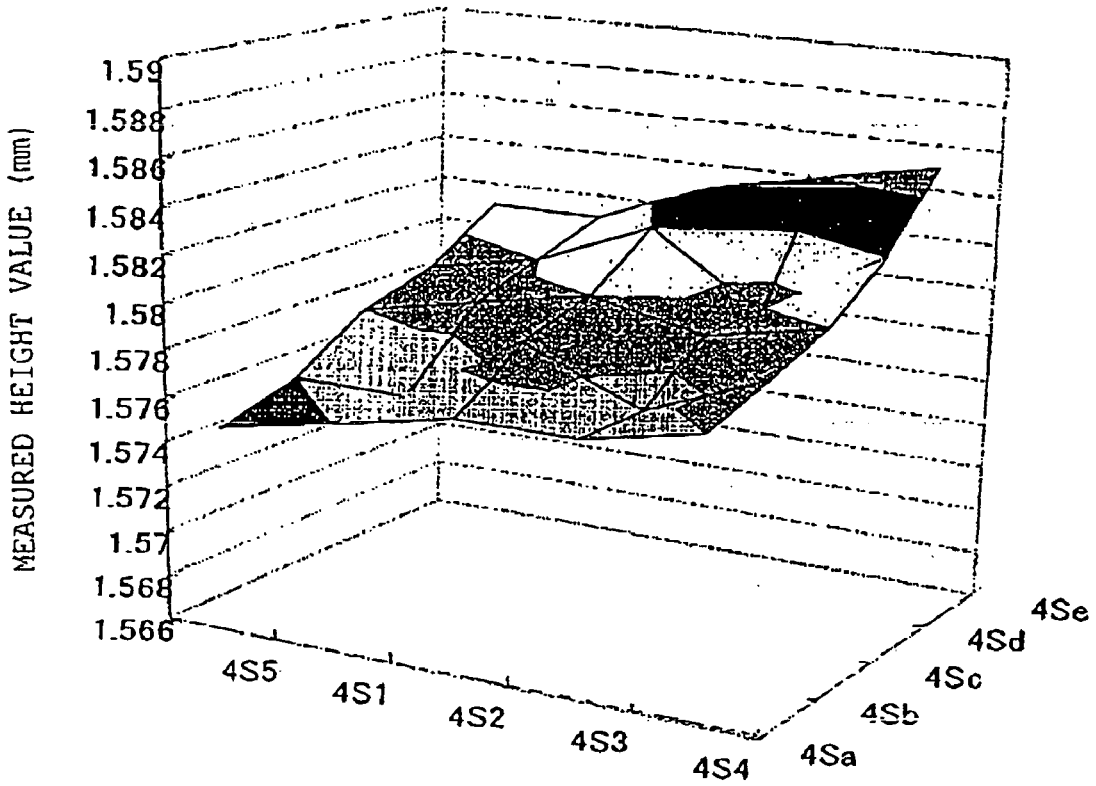
FIG. 13 is a diagram illustrating a planar distribution of the image display device in FIG. 11.

The in-plane height distribution at this time is illustrated in FIG. 13.

According to this embodiment, the variation in the heights between the adjoining spacers could be reduced while considering the height distribution in the longitudinal direction. As a result, the in-plane height distribution of the spacers could be made gentle without any protrusion. Therefore, it was possible to attain effects similar to those of the cases of the foregoing individual embodiments.

[Fourth Embodiment]

This embodiment draws a method for calculating the threshold values at the time of controlling the arrangement of the plate-shaped spacers while considering the characteristics of the substrates, too.

First of all, the calculation method is described with reference to FIG. 14, in which only three spacers are shown for simplifying the description.

Plate-shaped spacers SP1, SP2 and SP3 have heights L1, L2 and L3, respectively, in relations of L1<L2<L3. Moreover; the plate-shaped spacers SP1, SP2 and SP3 are individually arrayed at a pitch of length a.

The difference in height between the virtual line joining the crests of SP1 and SP3 and SP2 is designated by ΔH.

As the difference ΔH becomes larger, the spacer SP2 may fail to contact with the substrates constructing the sealed container, when the sealed container arranging the plate-shaped spacers becomes vacuum.

In this embodiment, therefore, the array of the plate-shaped spacers is so selected that the difference ΔH may satisfy the following inequality:

$$\Delta H \leqq C_1 \cdot a^4/h^3.$$

Here: characters $C_1$ designates a constant depending on the material of the substrates (i.e., the face plate and the rear plate) or the like; letter a designates the interval (or pitch) of the plate-shaped spacers; and letter h designates the thickness of the substrates (i.e., the face plate and the rear plate).

The righthand side designates the value which corresponds to the maximum deformation when the substrates are pressed by the atmospheric pressure.

If the height difference ΔH satisfies the above-specified inequality, it is possible to prepare the vacuum sealed container, in which the oppositely arranged substrates and all the plate-shaped spacers contact.

This embodiment used a glass substrate (PD200 made by Asahi Glass Kabushiki Gaisha) having a thickness of 2.8 mm, for example, for the face plate (or the front plate) and the rear plate (or the back plate).

The plate-shaped spacers were prepared by arranging glass substrates worked to have a width of 0.2 mm, a height of 1.6 mm and a length of 800 mm, at a pitch of 24.6 mm.

Figure 15:
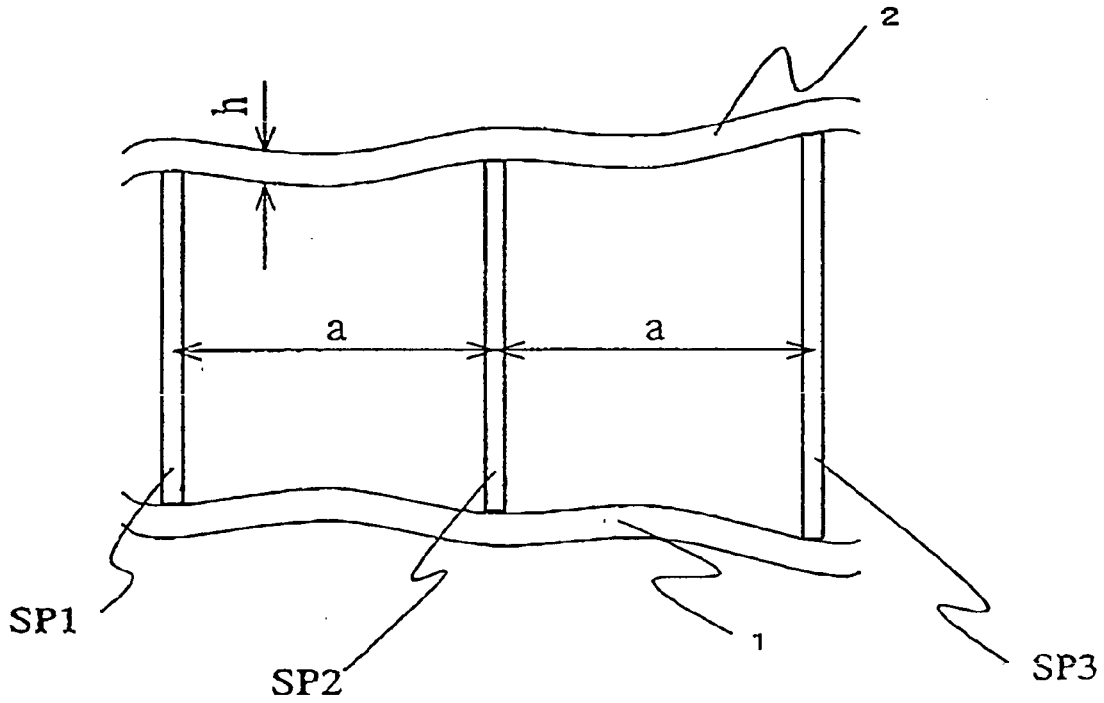
FIG. 15 is a diagram for explaining calculation methods of fourth and fifth embodiments.

At this time, the array of the plate-shaped spacers was so determined from the aforementioned inequality that the height difference ΔH might be 20 microns or less. Thus, it was possible to manufacture the image display device, in which all the plate-shaped spacers contact with the glass substrates (i.e., the faceplate and the rear plate) arranged opposite each other, as shown in FIG. 15.

[Fifth Embodiment]

In this embodiment, another example will be described on the method for calculating the threshold values at the time of controlling the arrangement of the plate-shaped spacers.

Figure 14:
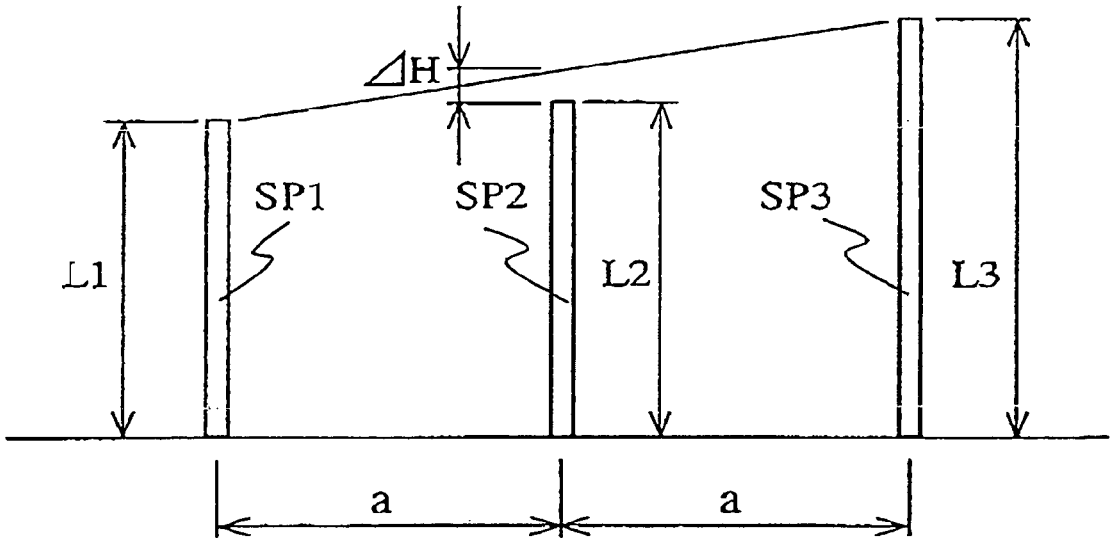
FIG. 14 is an explanatory diagram for controlling the difference in the height between adjoining spacers to a predetermined value or less.

Like the fourth embodiment, the plate-shaped spacers SP1, SP2 and SP3 have the heights of L1, L2 and L3, respectively, in the relations of L1<L2<L3, as shown in FIG. 14. Moreover, the plate-shaped spacers SP1, SP2 and SP3 are individually arrayed at the pitch of the length a. Still moreover, the height difference between the virtual line joining the crests of SP1 and SP2 and the SP3 is ΔH.

If the height difference ΔH becomes larger, a stress value to occur on the substrate surfaces just above the plate-shaped spacers may become larger. In this embodiment, therefore, the array of the plate-shaped spacers is so selected that the height difference ΔH may satisfy the following inequality:

$$\Delta H \leqq C_2 \cdot a^2/h\{\sigma_0 - C_3(a/h)^2\}.$$

Here: characters $C_2$ and $C_3$ designate constants depending on the materials of the substrates (i.e., the face plate and the rear plate) or the like; characters σ0 designate an allowable stress value; letter a designates the interval (or pitch) of the plate-shaped spacers; and letter h designates the thickness of the substrates (i.e., the face plate and the rear plate).

If the height difference ΔH satisfies the above-specified inequality, a stress at an allowable value or higher does not occur at the oppositely arranged substrates, so that a vacuum sealed container having no breakage can be prepared.

This embodiment used a glass substrate (of float sheet glass) having a thickness of 2.8 mm for the face plate and the rear plate.

The plate-shaped spacers were prepared by arranging glass substrates worked to have a width of 0.2 mm, a height of 1.6 mm and a length of 800 mm, at a pitch of 26 mm. The allowable stress value used was 6.9 MPa, which corresponded to the long-term breakage stress of the general float sheet glass. Moreover, the array of the plate-shaped spacers was so determined from the aforementioned inequality that the height difference ΔH might be 5.2 microns or less. Thus, it was possible to manufacture the image display device of no breakage, in which all the plate-shaped spacers contacted with the glass substrates (i.e., the face plate and the rear plate) arranged opposite each other, as shown in FIG. 15.

[Sixth Embodiment]

In this embodiment, columnar spacers are used as the support members for supporting the face plate and the rear plate.

Figure 16:
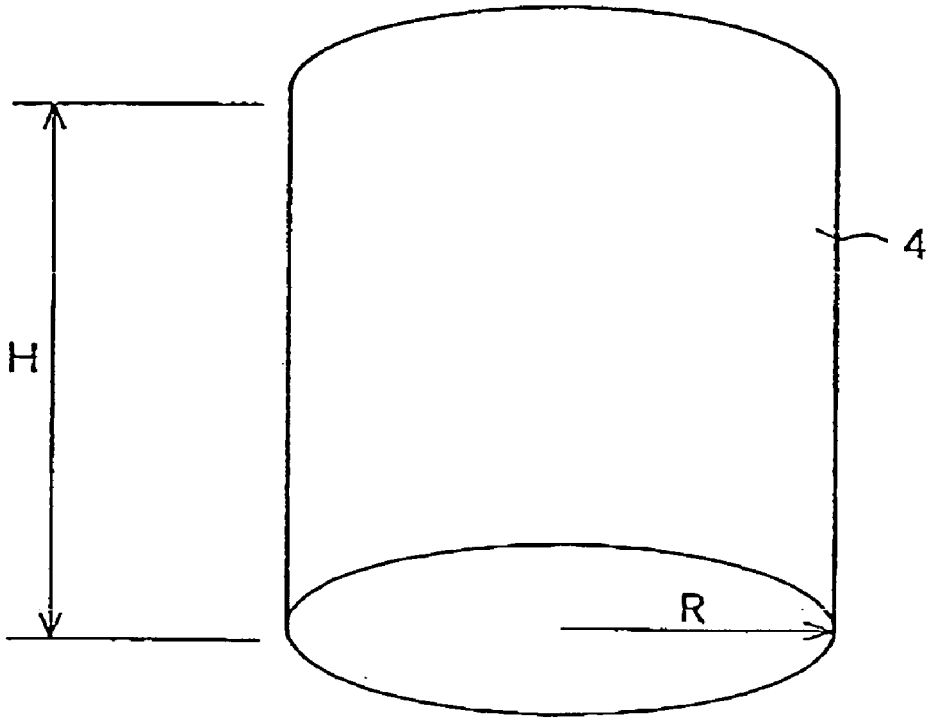
FIG. 16 is a perspective view of a spacer for explaining the definition of a columnar spacer.
Figure 17:
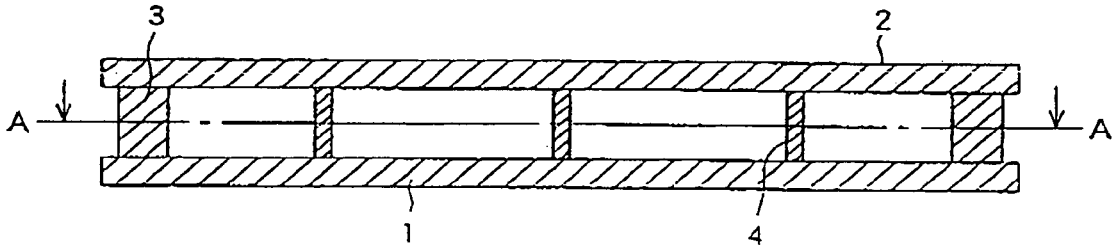
FIG. 17 is a sectional view of an image display device for explaining the definition of the columnar spacer.

A columnar spacer 4 is exemplified by a spacer of a cylindrical shape having a circular section (of a radius R) and a height H, as shown in FIG. 16. Here, the columnar spacer is defined such that a representative length C of a section representing the shape of a section (e.g., section A—A in FIG. 17) taken in a plane perpendicular to the direction of the spacing kept by the spacer satisfies an inequality of C<H. The representative length C is a diameter (2R) for a columnar spacing having a circular section, a major axis length for an elliptical column spacer having an elliptical section, and the largest diagonal length for a prism having a polygonal section.

A construction diagram of an image display device using the columnar spacers thus far described will be explained with reference to FIG. 18.

Figure 18:
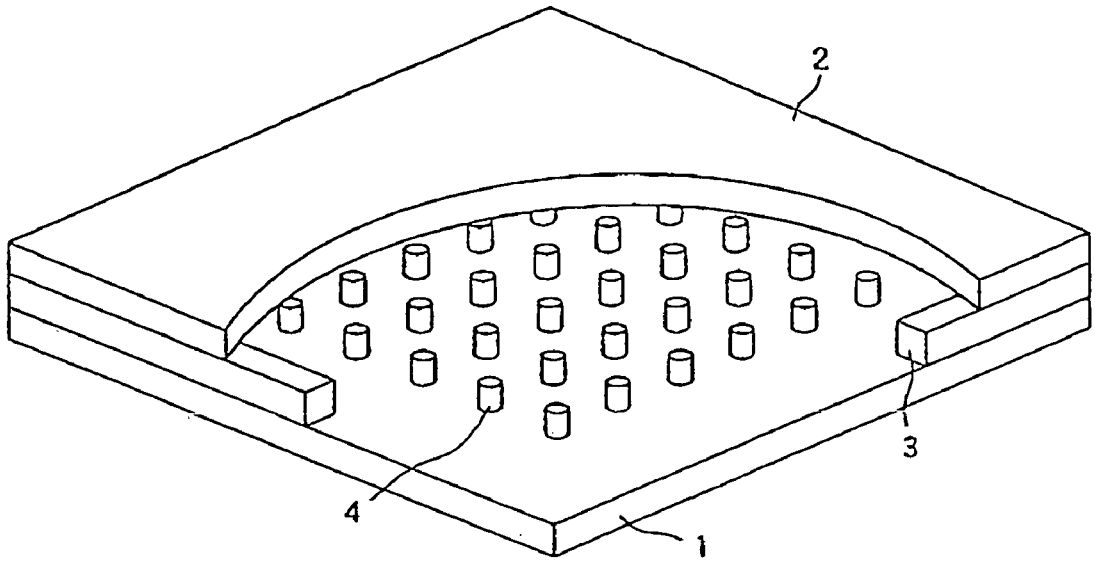
FIG. 18 is a partially broken perspective view of an image display device which is provided with a plurality of columnar spacers arranged between a pair of substrates arranged opposite each other.

In FIG. 18: numeral 1 designates a rear plate; numeral 2 a face plate arranged at a position opposite the rear plate 1; numeral 3 an outer frame arranged to keep the distance of the two substrates at a constant value and adhered gastight with the not-shown frit glass; and numeral 4 the columnar spacers arranged between the two substrates.

Figure 19:
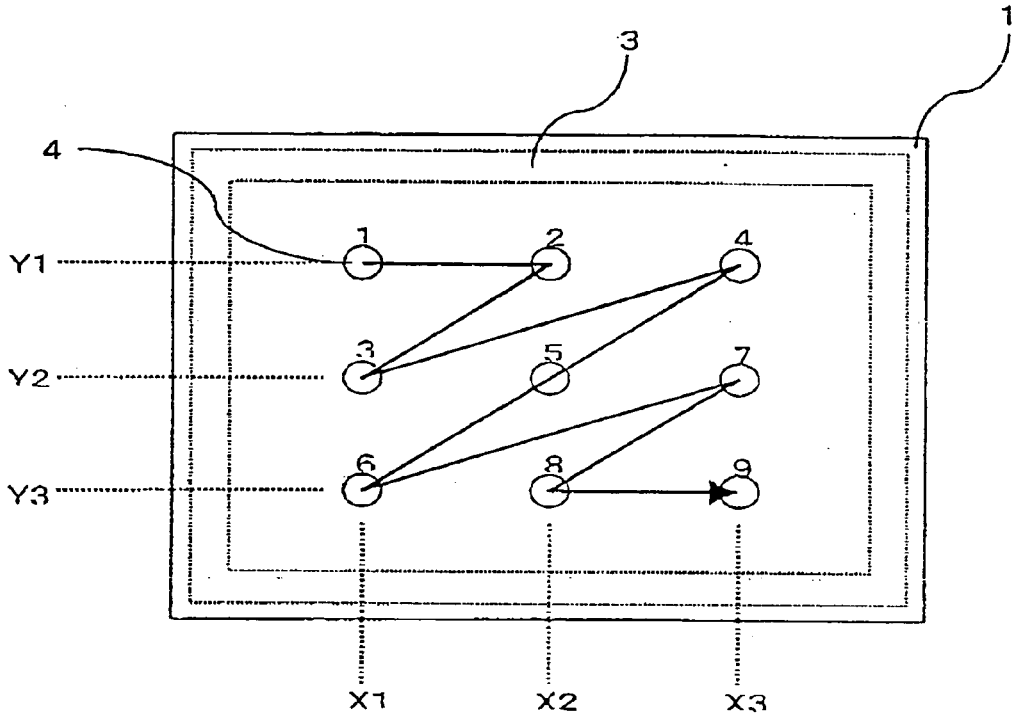
FIG. 19 is a conceptional diagram for arranging nine columnar spacers on the basis of a height H.

FIG. 19 is a diagram for explaining the arrangement relations among the columnar spacers 4 in the image display device, in which the columnar spacers 4 arranged are nine, for example.

Figure 20:
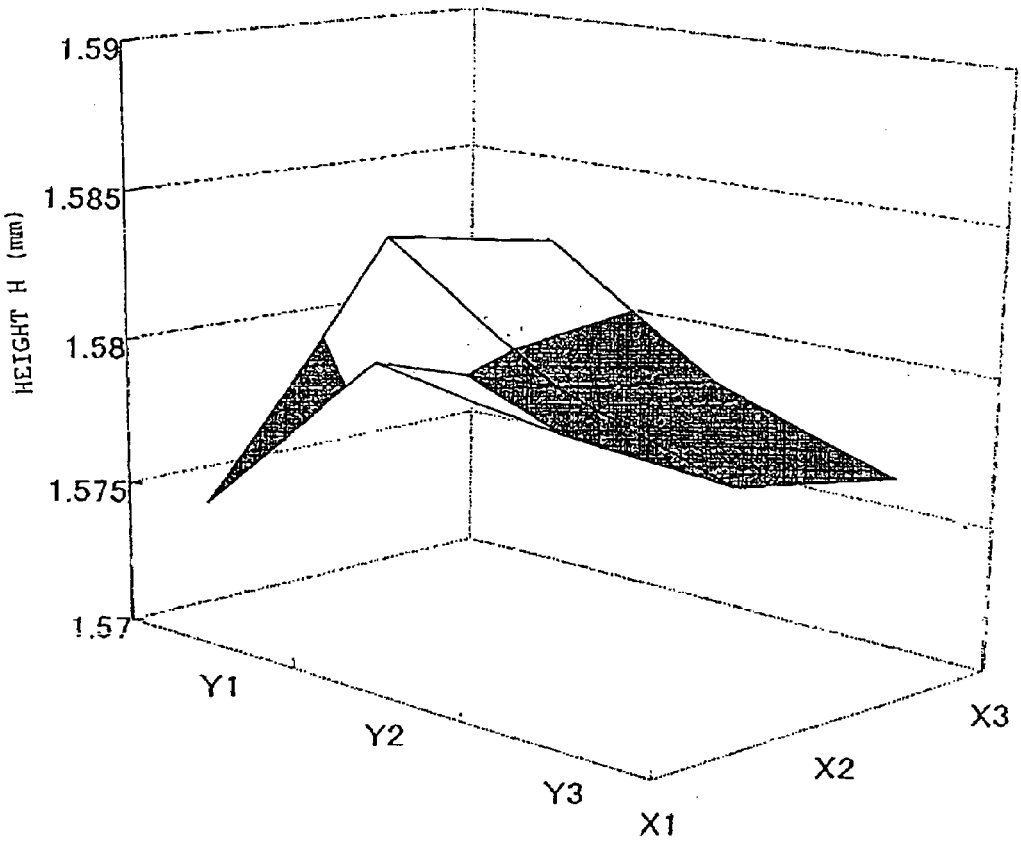
FIG. 20 is a diagram showing an example of an in-plane height distribution when the columnar spacers are arranged at random.

FIG. 20 is an in-plane distribution diagram using the data of the height H of the individual columnar spacers selected at random.

In this embodiment, the columnar spacers are arranged in the sequential order of the larger heights H based on the data of the heights H. Here, the array rule of this case is that the columnar spacers are arranged at one corner in the plane and then sequentially at 1 to 9 in the diagonal directions from the larger ones as shown in FIG. 19.

Figure 21:
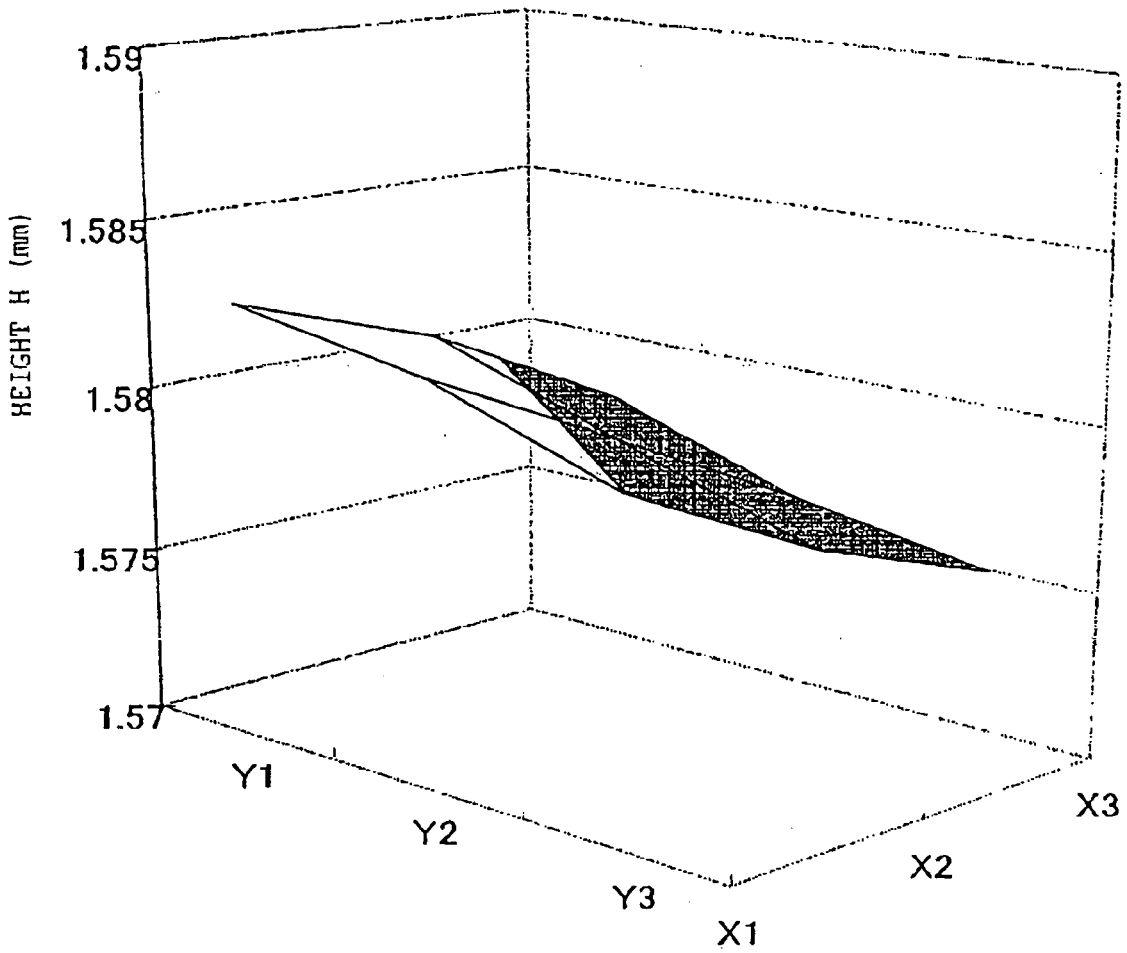
FIG. 21 is a diagram showing an example of an in-plane height distribution when the columnar spacers are arranged on the basis of the height H.

FIG. 21 illustrates an in-plane distribution diagram of the heights H after rearranged. As a result, it is possible to manufacture an image display device, the sectional shape of which is controlled in a wedge shape from one corner to an opposite corner.

Thus, the variation in the heights between the adjoining columnar spacers could be reduced to provide effects like those of the foregoing individual embodiments.

[Seventh Embodiment]

Figure 22:
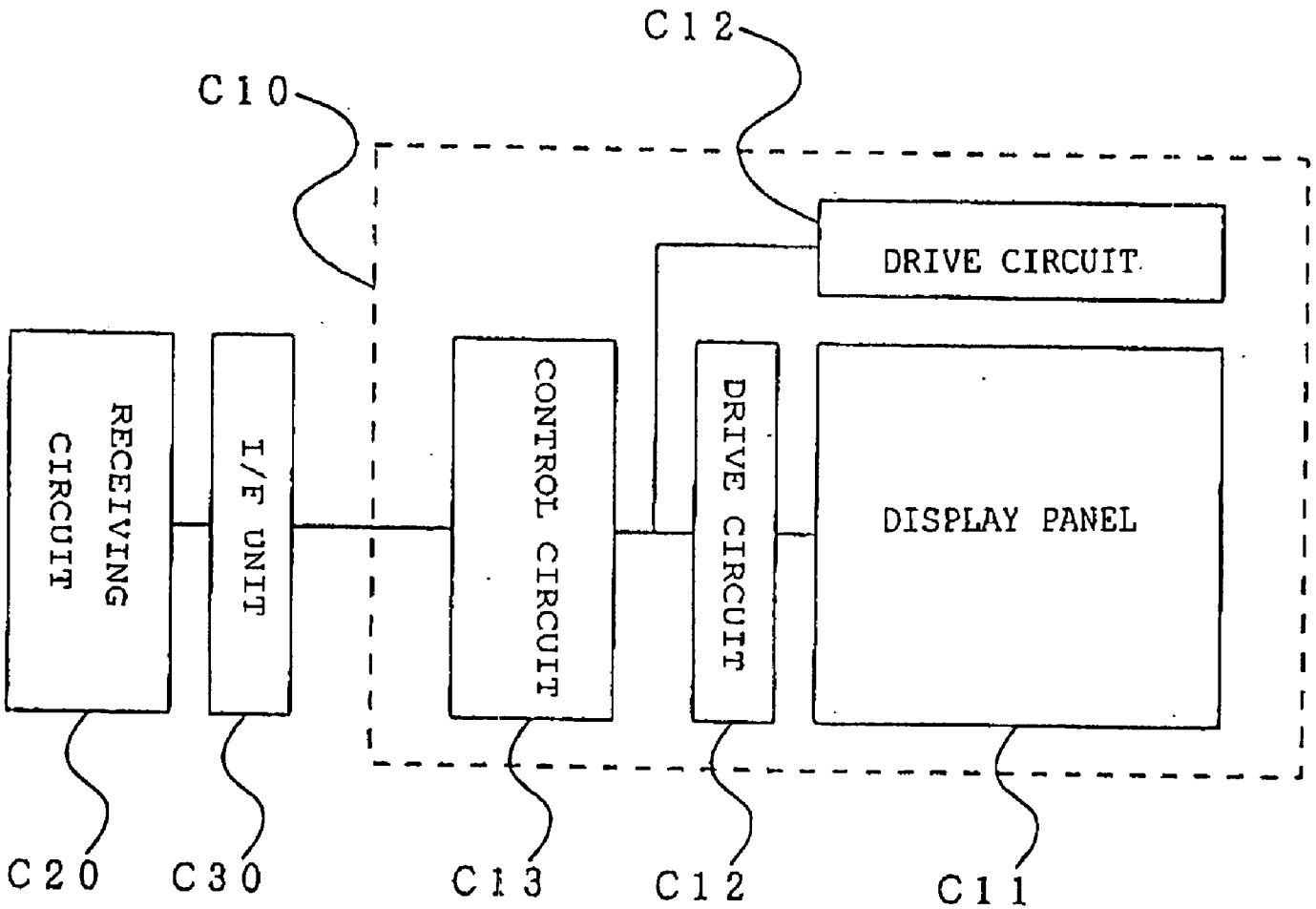
FIG. 22 is a block diagram of a TV apparatus according to an embodiment of the invention.

FIG. 22 is a block diagram of a TV apparatus according to an embodiment of the invention. A receiving circuit C20 is composed of a tuner, a decoder and so on. This receiving circuit C20 receives the TV signals of satellite broadcastings or ground waves and soon, and data broadcasting through networks, and outputs decoded video data to an I/F unit C30. This I/F unit C30 converts the video data into the display format of an image display device C10, and outputs the image data to the image display device C10. This image display device C10 is provided with a display panel C11, drive circuits C12 and a control circuit C13. This control circuit C13 subjects the inputted image data to an image processing such as a correction processing suited for the display panel C11, and outputs the image data and various control signals to the drive circuits C12. The drive circuits C12 output drive signals to the display panel C11 on the basis of the image data inputted. As a result, the TV image is displayed in the display panel C11.

The receiving circuit C20 and I/F unit C30 may be put in a different case than that of the image display device C10 as a set top box (STB) or the case of the image display device C10.

This application claims priority from Japanese Patent Application No.2003-293956 filed Aug. 15, 2003, which is hereby incorporated by reference.

What is claimed is:

1. An image display device comprising:

a rear plate having a plurality of electron emitting devices arranged thereon;

a face plate arranged opposite said rear plate and having image forming members arranged for forming images when irradiated with electron beams emitted from said electron emitting devices; and a plurality of spacers arranged between said face plate and said rear plate and from one end to an opposite end and in a sequential order of increasing heights.

2. A TV apparatus comprising:

an image display device including: a rear plate having a plurality of electron emitting devices arranged thereon;

a face plate arranged opposite said rear plate and having image forming members arranged for forming images when irradiated with electron beams emitted from said electron emitting devices; and a plurality of spacers arranged between said face plate and said rear plate and from one end to an opposite end and in a sequential order of increasing heights; and a receiving device for receiving TV signals.

* * * * *

UNITED STATES PATENT AND TRADEMARK OFFICE

CERTIFICATE OF CORRECTION

PATENT NO. : 7,088,036 B2
APPLICATION NO. : 10/914281
DATED : August 8, 2006
INVENTOR(S) : Makoto Kanda et al.

It is certified that error appears in the above-identified patent and that said Letters Patent is hereby corrected as shown below:

COLUMN 2:

Line 60, “jointing” should read --joining--.

COLUMN 3:

Line 38, “of the” should read --of the invention;--.

COLUMN 4:

Line 22, “conceptional” should read --conceptual--.
Line 50, “referred to” should read --referred to in--.
Line 54, “referred to” should read --referred to in--.

COLUMN 9:

Line 6, “Gaisha)” should read --Kaisha)--.

COLUMN 10:

Line 49, “and soon,” should read --and so on,--.

Signed and Sealed this

Twenty-ninth Day of April, 2008

JON W. DUDAS
*Director of the United States Patent and Trademark Office*